US005592262A

United States Patent [19]

Tanaka et al.

[11] Patent Number: 5,592,262

[45] Date of Patent: * Jan. 7, 1997

[54] IMAGE FORMING APPARATUS WITH INK JET AND ELECTROPHOTOGRAPHIC RECORDING UNITS

[75] Inventors: Kiyoharu Tanaka, Tokyo; Takashi Uchida, Yokohama; Akira Hiramatsu, Yokohama; Haruhiko Takahashi, Yokohama; Atsushi Munakata, Yokohama, all of Japan

[73] Assignee: Canon Kabushiki Kaisha, Tokyo, Japan

[ * ] Notice: The term of this patent shall not extend beyond the expiration date of Pat. No. 5,321,467.

[21] Appl. No.: 208,685

[22] Filed: Mar. 11, 1994

Related U.S. Application Data

[62] Division of Ser. No. 110,196, Aug. 23, 1993, Pat. No. 5,321,467, which is a continuation of Ser. No. 877,757, May 4, 1992, abandoned.

[30] Foreign Application Priority Data

May 7, 1991 [JP] Japan ..... 3-130247
Apr. 23, 1992 [JP] Japan ..... 4-104790

[51] Int. Cl.[6] ..... G03G 15/00; B41J 2/01

[52] U.S. Cl. ..... 399/1; 347/3

[58] Field of Search ..... 355/200, 202, 355/244, 319; 346/44; 347/2, 3, 4

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,629,172 | 12/1986 | Kameyama et al. | 271/9.13 |
| 4,723,129 | 2/1988 | Endo et al. | 346/1.1 |
| 4,740,796 | 4/1988 | Endo et al. | 346/1.1 |
| 4,972,236 | 11/1990 | Hasegawa | 355/319 |
| 4,994,865 | 2/1991 | Nishimori et al. | 355/324 |
| 5,081,596 | 1/1992 | Vincent et al. | 346/444 |
| 5,321,467 | 6/1994 | Tanaka et al. | 355/202 |

FOREIGN PATENT DOCUMENTS

| | | | |
|---|---|---|---|
| 54-056847 | 5/1979 | Japan . | |
| 55-083079 | 6/1980 | Japan . | |
| 58-168057 | 10/1983 | Japan . | |
| 59-123670 | 7/1984 | Japan . | |
| 59-138461 | 8/1984 | Japan . | |
| 60-071260 | 4/1985 | Japan . | |
| 2-183272 | 7/1990 | Japan | 355/202 |
| 4-069694 | 3/1992 | Japan | 355/202 |

*Primary Examiner*—Joan H. Pendegrass
*Attorney, Agent, or Firm*—Fitzpatrick, Cella, Harper & Scinto

[57] ABSTRACT

An image forming apparatus comprises a plurality of different image forming units for recording with different methods. An ink jet recording unit is arranged on the upstream side of an electrophotography recording unit in a transporting path of a recording medium. Recording of the ink jet recording unit is performed prior to that of the electrophotography recording unit.

32 Claims, 8 Drawing Sheets

| FIG. 3A | FIG. 3B |
|---|---|

31
I
T
S
52

IMAGE FORMING APPARATUS WITH INK JET AND ELECTROPHOTOGRAPHIC RECORDING UNITS

This application is a division of application Ser. No. 08/110,196 filed Aug. 23, 1993, now U.S. Pat. No. 5,321,467, which is a continuation of application Ser. No. 07/877,757 filed May 4, 1992, abandoned.

BACKGROUND OF THE INVENTION

1. Field of the Invention

The present invention relates to an image forming apparatus for forming an image in accordance with an image signal or an original image, and more particularly to an image forming apparatus which is provided in a single body with a plurality of image forming means according to different methods.

2. Related Background Art

Conventionally, there have been put into practical use an image forming apparatus employing a variety of image forming means, Particularly, a page printer for forming an image by an electrophotography method is excellent in an image forming speed and silent operation and therefore widely used as a copy machine and an output device for a computer. In addition, an electrophotography apparatus capable of forming an image in a plurality of colors has also been developed for printing a multiple-color image and a pictorial image, however, it cannot be said that this type of apparatus is suitable, due to a complex mechanism, a cumbersome body, and high running and initial costs.

In the multiple-color image formation, a recording apparatus according to an ink jet method, a multi-color image forming apparatus of thermal transfer type, and so on have also been practically used in order to remove the above-mentioned defects of the electronic photography systems. Further, another image forming apparatus has been devised by combining image forming means of these different methods so as to utilize merits of the respective image forming methods. An example of such a combination type apparatus may be an image forming apparatus that forms a monochrome-image, which accounts for the greater part of image formation, by utilizing an image forming means according to the electrophotography method because of its faster image forming speed and lower running cost, and a multiple-color image by utilizing an image forming means according to the ink jet method or a thermal transfer method which is advantageous in a running cost, an initial cost, the size, and so on.

For forming a full color image by the electronic photography method, an apparatus must have a plurality of color developers for a single photo-sensitive member. It is also necessary to provide a plurality of transfer drums for sequentially carrying a recorded material to transfer color toners multiple times and parallelly arranged process kits including photo-sensitive members and developers. The apparatus, therefore, becomes extremely complicated and large in size, which results in difficulties in maintenance and an expensive running cost.

On the other hand, the image formation by the ink jet recording method and the thermal transfer method is advantageous in reducing the size of apparatus and ignorably low noise generated during a recording operation. However, improvement on productivity cannot be expected, even for monochrome or single color recording, to the image formation by the ink jet recording method in which a plurality of recording heads are reciprocally moved to perform recording.

The thermal transfer method presents difficulties in resolution and gradation, and particularly is significantly inferior to the other two recording methods in color reproductivity.

Generally, an office automation machine is required to be small in size and inexpensive. In addition, a high image quality as well as a high speed operation and good productivity are required for monochrome recording while color reproductivity and high-grade image quality are required for full color recording.

Incidentally, it is known to record a monochrome image at a high speed by the electrophotography method and thereafter paint particular colors on the image by the compact and inexpensive ink jet recording method (Japanese Laid-Open Patent Application No. 55-83079) and to record a monochrome image at a high speed by the electrophotography method and thereafter paint color portions on the image by the ink jet recording method (Japanese Laid-Open Patent Application No. 58-16857).

However, since both of the above-mentioned techniques paint certain portions on an image by the ink jet recording method after the image has been recorded by the electrophotography recording method, there are problems to be solved. Such problems will hereinafter be explained with reference to drawings used for explaining an embodiment according to the present invention.

a) If an ink jet recording unit 3 is disposed between an electronic photography recording unit 4 and a fixing means 70:

a-1) Since process speeds of the recording units 3 and 4 are largely different, a distance between the recording units 3 and 4 must be more than a maximum length of a recording sheet 52, whereby the apparatus becomes larger. To avoid this problem, the recording sheet 52 may be once accommodated in a different carrying means and then introduced into the ink jet recording unit 3. However, since an unfixed toner image is present on the recording sheet 52, this mechanism cannot be put into practice because the unfixed toner image is perturbed by carrying rollers, guides and so on.

a-2) Supposing that the ink jet recording unit 3 provides a high recording density of, for example, 400 dpi, a discharging port density of a recording head is 63.5 μm. On the other hand, the diameter of a toner particle generally ranges from several μm to about fifty μm. Thus, if ink I is discharged onto an unfixed toner image T, as shown in FIG. 5A, the ink I impacts the toner image T, splashes out toner and consequently perturbs the toner image T.

a-3) Generally, a gap of about 1 mm or less must be provided between the recording head 31 and the recording sheet 52, and the recording sheet 52 must be maintained in an even state. It is however extremely difficult to maintain the recording sheet 52 having the unfixed toner image thereon in an even state. Contact of the recording sheet 52 on the head 31 or a paper jam may cause clogging of a discharging port, which results in a non-discharge state or a poor discharge state of the recording head 31, whereby the recording head 31 is rendered inoperable.

It is apparent that the above-mentioned troubles due to the unfixed toner image T can be completely solved by performing the ink jet recording prior to the electronic photography recording. Further, by providing the apparatus with a fan 71 (see FIG. 1) for collecting dust and exhausting heat and arranging the ink jet recording unit 3 on the upstream side of an air flow generated by the fan 71, the recording head 31 can be completely protected from adverse influences due to dispersed toner particles from a developer 44 and a cleaner 46 of the electrophotography recording unit 4. The fan 71 may be operated at least for not less than a predetermined period from the completion of the operation performed by the electrophotography recording unit 4.

Next, a comparison will be made with another arrangement.

b) If the ink jet recording unit 3 is positioned behind the fixing means 70:

b-1) Since ink jet recording is performed on the recording sheet 52 having thereon a fixed toner image T, the recording head 31 will not suffer from influences due to toner particles. However, heat from the fixer 70 or from the recording sheet 52 with the fixed image T possibly causes the ink I on the discharging face of the recording head 31 to become viscous, and accordingly the recording head 31 falls into a non-discharge disabled state or a poor discharge or a twisted state.

b-2) Generally, a main component of toner is, an agglutinative resin, for example, polyester, styreneacryl, or epoxy resin. A toner image is fixed by applying heat and pressure thereto by a pair of heat rollers. The surfaces of the heat rollers are applied with, for example, silicone oil S having an excellent separability in order to prevent toner on the recording sheet 52 from being transferred onto the heat rollers. For this reason, even in synthetic recording, such silicone oil S may adhere to the recording sheet 52, whereby ink is repelled or cannot easily reach a fiber layer inside the recording sheet 52. This problem is serious particularly for a color image which is recorded by a plurality of colors of ink. If ink does not promptly permeate into the recording sheet 52, the ink will be left wet on the sheet. When this sheet is piled on a sheet discharging tray 66, the image thereon will be perturbed by a recording sheet 52 to be next discharged (see FIG. 5B). In multiple recording for recording an image on a toner image T by ink I, particularly in an area where a toner density is high, since a recording sheet 52 is completely coated with the toner image T, the ink I can never reach the surface of the recording sheet 52, whereby the ink I runs over even during a recording operation (see FIG. 5C).

SUMMARY OF THE INVENTION

It is an object of the present invention to provide a compact and inexpensive image forming apparatus which is capable of mainly realizing a high image quality as well as a high speed operation and a good productivity for monochrome image formation and a high color reproductivity and a high-grade image quality for color image formation.

It is another object of the present invention to provide a compact image forming apparatus adapted to record a plurality of images on a single recording medium which is capable of reducing a time required to record images, forming a monochrome image with a high productivity at a high speed by an electrophotography method, and forming a high-grade full color image by an ink jet recording method.

It is a further object of the present invention to provide an image forming apparatus which can be reduced in size without extending a distance between an electronic photography recording unit and an ink jet recording unit longer than a maximum recordable length of a recording medium, as has been conventionally required due to a large difference in process speed between the electrophotography recording method and an ink jet recording method.

According to a first aspect of the present invention, there is provided an image forming apparatus for forming an image on a recording medium comprising:

first image forming means for forming an image on a recording medium;

second image forming means for forming an image on the recording medium by an image forming system different from that of said first image forming means;

means for exhausting the recording medium on which an image has been formed out of said apparatus;

a first recording medium conveyance path for conveying the recording medium to said exhausting means and out of said apparatus after passing by said first and second image forming means; and a second recording medium conveyance path for conveying the recording medium to said exhausting means and out of said apparatus after passing by said first image forming means.

According to a second aspect of the present invention, there is provided an image forming apparatus for forming an image on a recording medium comprising:

first image forming means for forming an image on a recording medium;

second image forming means for forming an image on the recording medium by an image forming system different from that of said first image forming means;

loading means for loading the recording medium;

receiving means for-receiving the recording medium after the image is recorded;

means for exhausting the recording medium on which an image has been formed to said receiving means;

a first recording medium conveyance path for conveying the recording medium fed from said loading means to said exhausting means and said receiving means after passing by said first and said second image forming means; and a second recording medium conveyance path branching from said first recording medium conveyance path downstream of said first image forming means and upstream of said second image forming means with respect to a conveying direction of the recording medium to convey the recording medium on which the image is recorded by said first image forming means to said exhausting means and said receiving means.

According to a third aspect of the present invention, there is provided an image forming apparatus for forming an image on a recording medium comprising:

first image forming means for forming an image by an ink jet image forming system and for discharging ink from a nozzle to form an image on the recording medium;

second image forming means for forming an image on the recording medium by an electrophotographing image forming system different from that of said first image forming means;

means for exhausting the recording medium on which an image has been formed out of said apparatus;

a first recording medium conveyance path for conveying the recording medium to said exhausting means and out of said apparatus after passing by said first and second image forming means; and a second recording medium conveyance path for conveying the recording medium to said exhausting means and out of said apparatus after passing by said first image forming means.

According to a fourth aspect of the present invention, there is provided an image forming apparatus for forming an image on a recording medium comprising:

first image forming means for forming an image by an ink jet image forming system and for discharging ink from a nozzle to form an image on the recording medium;

second image forming means for forming an image on the recording medium by an electrophotographing image forming system different from that of said first image forming means;

loading means for loading the recording medium;

receiving means for receiving the recording medium after the image is recorded;

means for exhausting the recording medium on which an image has been formed to said receiving means;

a first recording medium conveyance path for conveying the recording medium fed from said loading means to said exhausting means and said receiving means after passing by said first and said second image forming means; and a second recording medium conveyance path branching from said first recording medium conveyance path downstream of said first image forming means and upstream of said second image forming means with respect to a conveying direction of the recording medium to convey the recording medium on which the image is recorded by said first image forming means to said exhausting means and said receiving means.

DESCRIPTION OF THE PREFERRED EMBODIMENTS

An image forming apparatus according to the present invention will hereinafter be described based on embodiments shown in the accompanying drawings.

Figure 1:
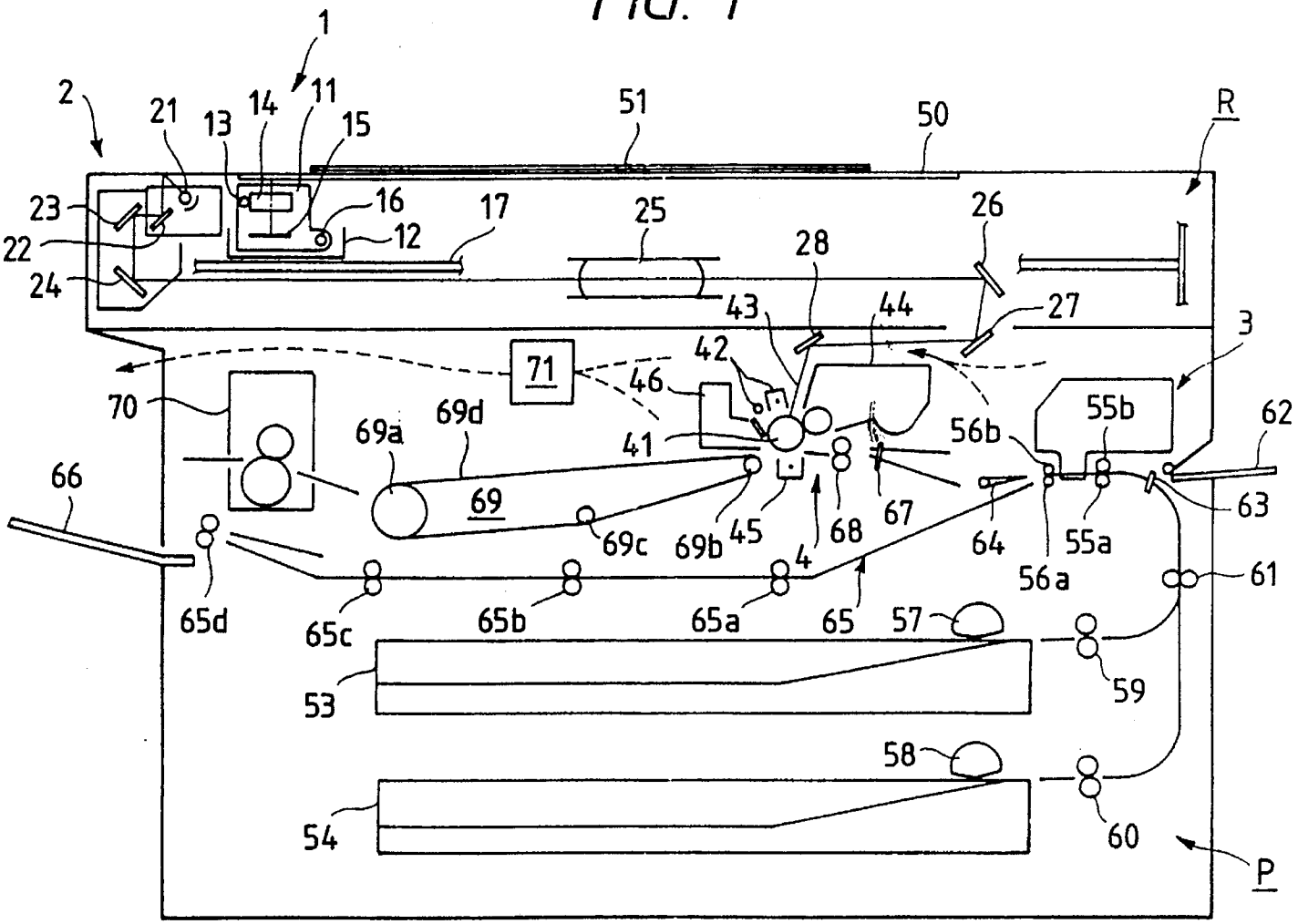
FIG. 1 is a cross-sectional view showing a copy machine to which an image forming apparatus of an embodiment according to the present invention is applied.

FIG. 1 is a cross-sectional view showing a copy machine to which an image forming apparatus according to the present invention is applied. The copy machine mainly consists of an image reading section R and an image forming section P. An original 51 is placed on an original supporting glass 50 in the image reading unit R. An image is read by a reading unit 1 for ink jet recording constituting a first image forming means and a reading unit 2 for electrophotography recording constituting a second image forming means. It is also possible to specify an image area by an editor E, not shown. The reading unit 1 has a first carriage (main scan) 11 and a second carriage (sub-scan) 12. The first carriage 11 is provided thereon with an original illuminating lamp 13, a light converging lens 14 and a CCD line sensor 15. In this embodiment, the CCD line sensor 15 has blue, green and red color resolving filters for dividing each pixel into three on a light receiving face, where a pixel array is arranged in the horizontal direction (a sub-scanning direction) in FIG. 1. The first carriage 11 serially moves on a main scanning rail 16 arranged on the second carriage 12 to read an image. When the first carriage 11 goes and comes back once, the second carriage 12 moves on a sub-scanning rail 17 suspended in the image reading section R by a reading width of the CCD line sensor 15 and stops. The whole image face of the original 51 is read as digital signals by repeating this operation.

The reading unit 2 for electrophotography recording, on the other hand, is formed of a known analog optical system as shown in FIG. 1. Specifically, an original illuminating lamp 21 and a first mirror 22 integrally move on the sub-scanning rail 17, while a second mirror 23 and a third mirror 24 likewise integrally move on the sub-scanning rail 17 at a speed half as fast as that of the lamp 21 and the mirror 22. The whole image face of the original 51 is thus read as analog signals. Then, a latent image light is introduced by a lens 25 through a group of mirrors 26, 27 and 28 to a photo-sensitive member 41 in an electronic photography recording unit 4, later referred to.

Since the image reading unit for ink jet recording and that for electronic photography recording are thus separately constructed, inexpensive and compact structures can be employed for the respective recording methods. Also advantageously, even if one of the reading units breaks down, the other one can be used for recording an image.

The image recording section P has a plurality of recording units for different recording methods, as shown in FIG. 1. In this embodiment, the image recording section P comprises an ink jet recording unit 3 at a first position and the electrophotography recording unit 4 at a second position downstream of the former in the recording medium (recording sheet) feeding direction. This structure is based on a principle that an ink jet recording method is employed for realizing a reduction in size of the apparatus and color image recording, and an electrophotography recording method is employed for realizing a high speed monochrome copy. A distance between both of the recording units 3 and 4 is made shorter than the length of a recording medium (recording sheet) to reduce the whole apparatus in size, as will be later described.

Generally in non-impact recording methods, noise generated during a recording operation is sufficiently small to be ignored, high speed recording can be carried out, and recording can be performed on a so-called ordinary sheet without the necessity of a particular fixing processing. The ink jet recording method is extremely effective among the non-impact recording methods.

A recording head assembly 31 (see FIG. 2) employed for the ink jet recording unit 3 is generally formed of fine liquid discharging ports (orifices), a liquid path, an energy acting portion arranged in part of this liquid path, and an energy generating means for generating liquid drop forming energy for acting on a liquid present in this acting portion. Since recording heads employed in the ink jet recording unit 3 adapted to discharge a liquid by thermal energy can highly densely array liquid discharging ports (orifices) for forming and splashing liquid drops for recording, high resolution recording can be achieved. Particularly, the recording head 31 employing an electric-thermal convertor as a thermal energy generating means is readily made compact, sufficiently utilizes merits of the IC technology and micro-machining technology which have presented remarkable progress and improvement on reliability in the recent semiconductor field, and is readily machined in an elongate form or a plane form (two-dimension). It is therefore possible to provide an ink jet recording head in which multiple nozzles or highly densely arrayed nozzles are readily arranged and which is suitable for mass production and inexpensive in manufacturing as well as an apparatus having this type of recording head.

Figure 2:
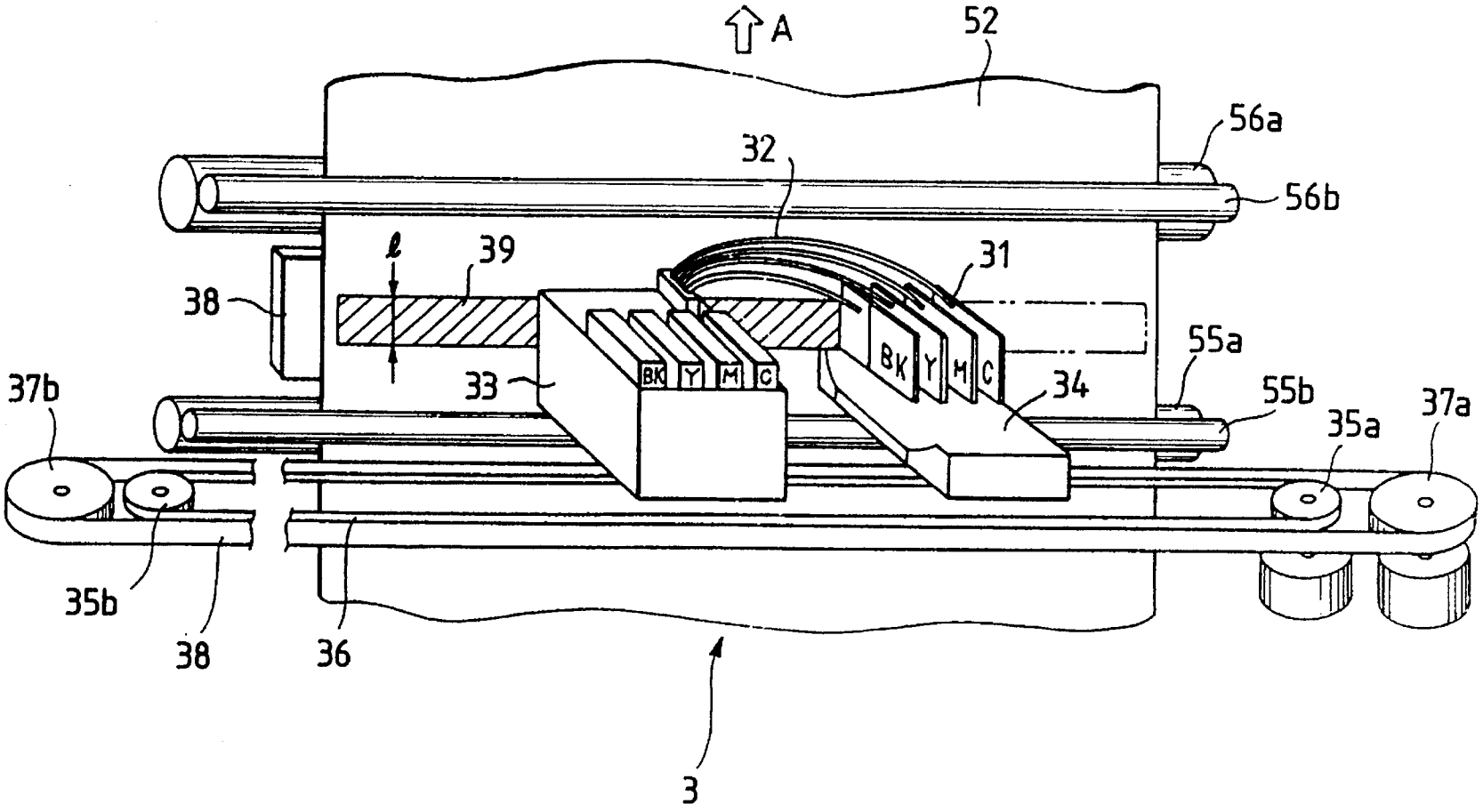
FIG. 2 is a perspective view schematically showing an ink jet recording unit constituting a first recording unit.

The ink jet recording unit 3 constituting the first image forming means is capable of color image recording. As shown in FIG. 2, the recording head 31 has a plurality of arrays of ink discharging ports in a main scanning direction (the horizontal direction in FIG. 2) and is formed of heads for cyan (C), magenta (M), yellow (Y) and black (Bl) ink. Each ink is supplied from an ink tank 33 through an ink supplying tube 32 to the recording head 31. The recording head 31 is mounted on the carriage 34 which is partly fixed on a belt 36 stretched between a driving pulley 35*a* and a dependent pulley 35*b* so as to be highly accurately driven in the main scanning direction (the horizontal direction in FIG. 2 and the depth direction in FIG. 1). The ink tank 33 is fixed on part of a belt 38 stretched between a driving pulley 37*a* and a dependent pulley 37*b* and movable in the main scanning direction similarly to the recording head 31. The ink tank 33 is also useful in solving stress applied to the ink supplying tube 32. The ink tank 33 is driven independently of the carriage 34 so as to prevent vibrations or the like generated by moving the relatively heavy ink tank 33 from being propagated to the recording head 31.

A recording paper or sheet 52 serving as a recording medium is transported by sheet feeding units 53 and 54, later described, and sandwiched by a first transporting means for performing ink jet recording comprising a first pair of transporting rollers 55*a*, 55*b* and a second pair of transporting rollers 56*a*, 56*b*. Recording is performed on the recording sheet 52 between the two pairs of rollers 55*a*, 55*b* and 56*a*, 56*b* by the recording head 31. A transporting speed of the second pair of transporting rollers 56*a*, 56*b* is made a bit higher than that of the first pair of transporting rollers 55*a*, 55*b* so that the recording paper 52 is maintained even between both the pairs of rollers 55*a*, 55*b* and 56*a*, 56*b*. Alternatively, the recording sheet 52 may be attracted to a platen 38 having a plane portion by an electro-static force or air.

Then, on the recording sheet 52 at a standstill, recording is started from the left end by the recording head 31 based on the foregoing image signal read by the image reading unit 1 and continued to the right end of the sheet 52 as shown by a recorded line 39. When one line portion of recording has been completed, the carriage 34 and the ink tank 33 are returned to the left end. In the meantime, the recording sheet 52 is transported by a length 1 of the one line portion in the direction indicated by an arrow A by the first and second pairs of transporting rollers 55*a*, 55*b* and 56*a*, 56*b*, and stopped again. The same operation is repeated to record an image on the recording sheet 52. The first and second pairs of transporting rollers 55*a*, 55*b* and 56*a*, 56*b* are forwardly and backwardly rotatable, the operation and effect of which will be later described.

The electrophotography recording unit 4 arranged at a downstream position in the direction indicated by the arrow A is provided around the photo-sensitive member 41 with a photosensitive member charging controller 42, an exposure unit 43, a developer 44, a transfer unit 45 and a cleaner 46, the structure of which is known and detailed explanation thereof will be omitted.

Next, description will be made as to an image recording process in the order of a transporting path of the recording sheet 52. A number of recording sheets are stacked in an upper cassette 53 and a lower cassette 54 serving as storage units which are mountable and removable in the front side of FIG. 1.

When one of the cassettes is selected by an instruction of the operator, a recording sheet 52 is introduced into an ink jet recording unit 3 constituting the first recording unit by pick-up rollers 57, 58 and a pair of transporting rollers 59, 60, which start operating upon feeding the recording paper 52, and a pair of common transporting rollers 61 (or introduced through a manual feeder 62). In response to an output of a sensor 63 for detecting the arrival of the top end of the recording sheet 52 at a location immediately before the ink jet recording unit 3, the top end of the recording sheet 52 is entered between a nip portion of the first pair of transporting rollers 55*a*, 55*b*. The recording sheet 52 is prevented from being obliquely transported by forming a loop, and then a recording process is entered by taking registration. In this event, a flapper 64 has the tip thereof directed upward to thereby introduce the recording paper 52 to the second transporting means 65 toward the ink jet recording unit 3. When ink jet recording only is performed, the recording sheet 52, after the ink jet recording has been completed, is transported by pairs of intermediate rollers 65*a*, 65*b* and 65*c* constituting the second transporting means 65 and discharged on a sheet discharging or receiving tray 66 by a pair of discharging rollers 65*d*. Thus, the ink jet recording unit 3 can create a full color image as described above.

When electrophotography recording only is performed, the ink jet recording unit 3 constituting the first recording unit is not operated so that the recording head 31 remains an standby out of the recording sheet transporting path. The recording sheet 52 passes through the ink jet recording unit 3 and is delivered to the electrophotography recording unit 4 constituting the second recording unit through the first pair of transporting rollers 55*a*, 55*b* and the second pair of transporting rollers 56*a*, 56*b*, constituting the first transporting means. In this event, the flapper 65 has the tip thereof directed downward. Then, the top end of the recording sheet 52 is detected, oblique transportation is prevented, registration is taken, and an electrophotography recording process is entered. After a toner image has been transferred to the recording sheet 52, the recording sheet 52 is transported by a third transporting means formed of a driving pulley 69*a*, a dependent pulley 69*b*, and a transporting belt 69*d* stretched by a tension pulley 69*c*, and discharged on the sheet discharging tray 66 after the toner image on the recording sheet 52 has been fixed. As described above, this mode is adapted to record a great number of monochrome images at a high speed.

The image forming apparatus of the present invention is capable of both ink jet recording and electrophotography recording as well as "synthetic" or "multiplex" recording on a single recording sheet. Here, the "synthetic" recording refers to the case where an ink jet recorded image area does not overlap a toner image area by the electrophotography recording, while the "multiplex" recording refers to the case where these two images overlap.

As to a process for creating a synthetic image or a multiplex image, ink jet recording is first performed by the ink jet recording unit 3 constituting the first recording unit. Similarly to the above described process, a recording sheet 52 is fed from the sheet feeder 53 or 54, ink jet recording is performed on the recording sheet 52 between the first pair of transporting rollers 55*a*, 55*b* and the second pair of transporting rollers 56*a*, 56*b*, constituting the first transporting means, and the recording sheet 52 is guided into the second transporting means 65 by the flapper 64 having the tip thereof directed upward. At the time ink jet recording has been completed on the last line, the recording sheet 52 is being sandwiched at least by the second pair of transporting rollers 56*a* and 56*b*. Then, the second pair of transporting rollers 56*a* and 56*b* are reversely rotated to transport the once recorded recording sheet 52 in the backward direction. In this event, the first pair of transporting rollers 55*a*, 55*b* and the pair of common rollers 61 are also reversely rotated or kept in a separate state. Then, when the top end of the recording sheet 52 is returned to the tip of the flapper 64 or to the nip portions of the second pair of transporting rollers 56*a* and 56*b*, the backward transport is stopped, and the second pair of transporting rollers 56*a* and 56*b* is forwardly rotated again with the flapper 64 having the tip thereof directed downward. The recording sheet 52 is introduced into the electronic photography recording unit 4, synchronized with the operation of the image reading unit by a pair of resist rollers 68, subjected to an electrophotography recording process, and delivered on the sheet discharging tray 66 through the third transporting means 69 and the fixing means 70.

Figures 3, 3A:
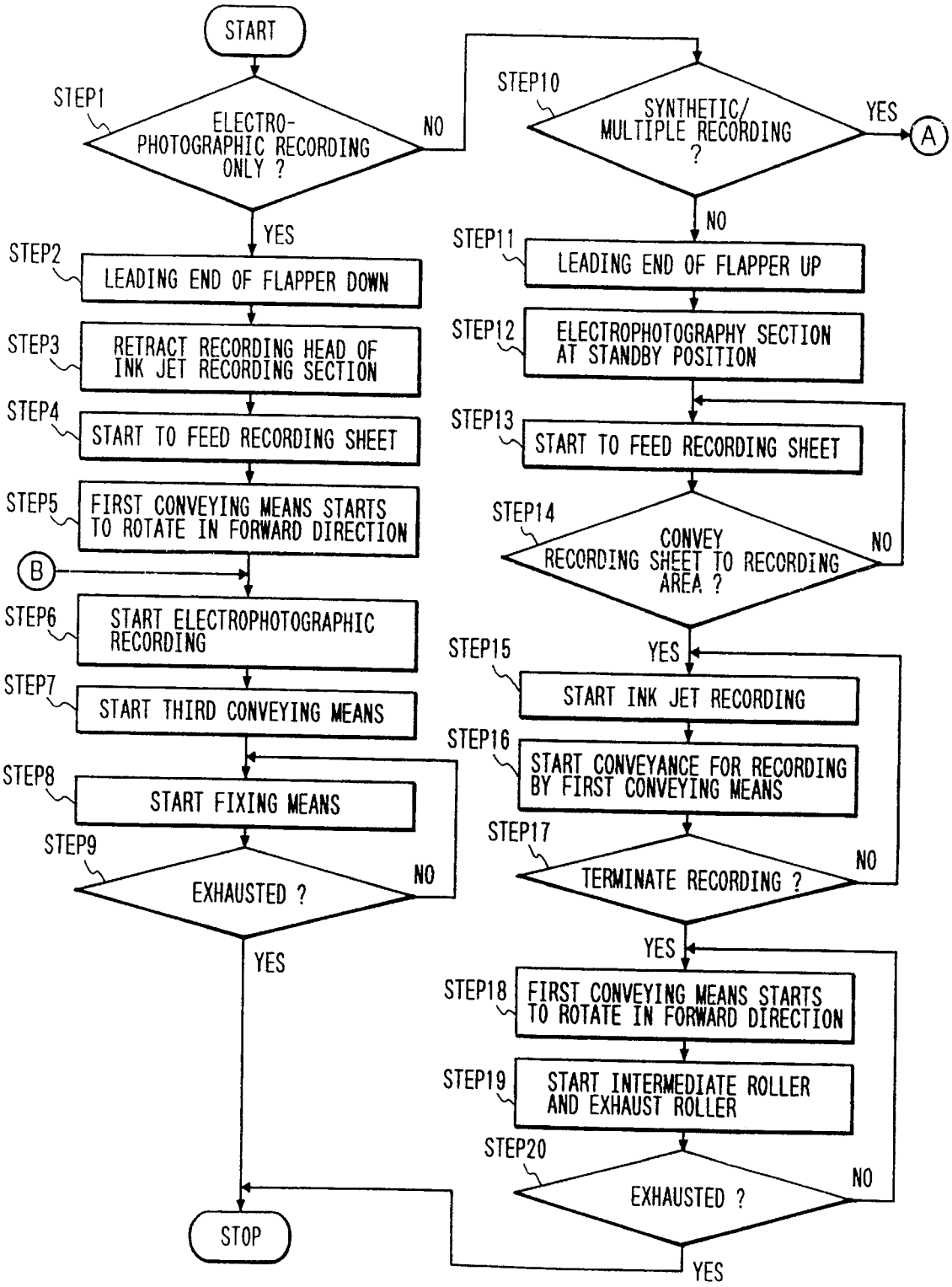
FIGS. 3A and 3B together depict a flow chart used for explaining the operation of a first embodiment of an image forming apparatus according to the present invention.
Figure 3B:
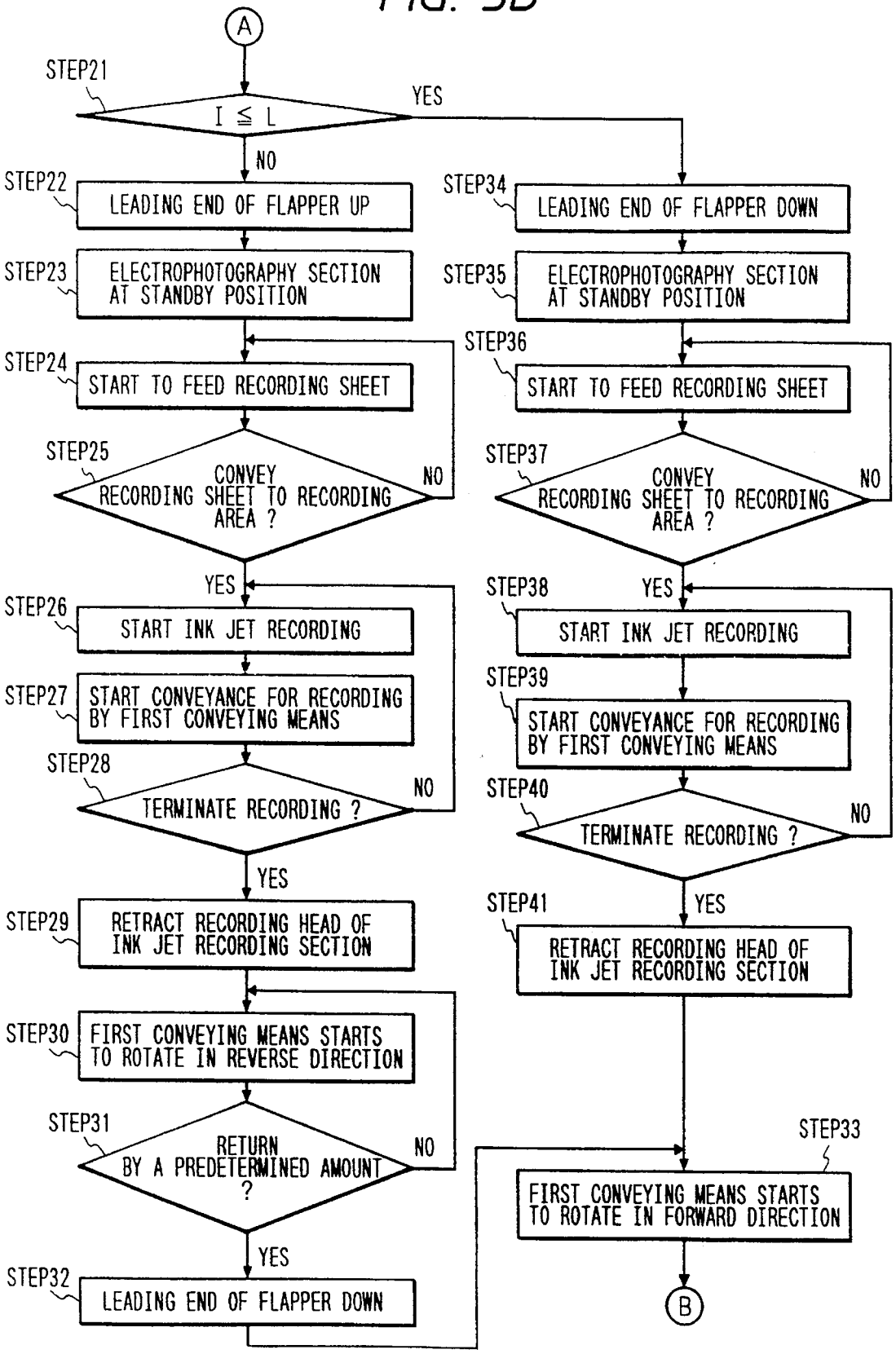

The above described operation will be explained in greater detail with reference to a flow chart of a first embodiment shown in FIGS. 3A and 3B.

First, the operator selects one from an electrophotography recording mode (monochrome copy mode), an ink jet recording mode (color recording mode, for example, monocolor or full color recording mode), a synthetic recording mode by using both the recording units, and a multiplex recording mode (for example, colored underlines, color conversion in a specified area, color painting, and base color).

When the electrophotography recording mode is selected (STEP 1), the flapper 46 is switched to direct the tip thereof downward (STEP 2), and the recording head 31 of the ink jet recording unit 3 stands by at a drawn position (STEP 3). Then, a recording sheet 52 is fed from one of the cassettes 53 and 54 or the manual feeder 62 (STEP 4), two pairs of rollers 55*a*, 55*b* and 56*a*, 56*b* are forwardly rotated (STEP 5) to transport the recording paper 52 to the pair of resist rollers 68. Afterward, the pair of resist rollers 68 are operated at a predetermined timing to enter a recording stage by an electrophotography process (STEP 6). Simultaneously, the third transporting means 69 is operated to transport the recording sheet 52 on which a toner image has been transferred (STEP 7), the toner image is fixed by the fixing means 7 (STEP 8), and the recording sheet 52 is discharged on the sheet discharging tray 66 (STEP 9).

If a mode selected at STEP 1 is not the electrophotography recording mode, the flow proceeds to STEP 10 where it is determined whether or not the synthetic or multiplex recording mode is selected. If not, the flapper 64 is switched to direct the tip thereof upward (STEP 11), and the electrophotography recording unit 4 is set in a standby state (STEP 12). Then, the recording sheet 52 is fed to the ink jet recording unit 3 up to its top end of a recording area (STEPS 13, 14). For example, if the whole area of the recording sheet 52 is the recording area, the recording sheet 52 is transferred and stopped until the top end thereof is about to be sandwiched by the second pair of transporting rollers 56*a*, 56*b*. If a recording area is specified by the editor E, the two pairs of transporting rollers 55*a*, 55*b* and 56*a*, 56*b* constituting the first transporting means are forwardly rotated to transport the recording sheet 52 by a length of an unrecording area from the top end thereof. Then, ink jet recording is started on the recording area of the recording sheet 52 (STEP 15). The first transporting means 55*a*, 55*b* and 56*a*, 56*b* transports the recording sheet 52 in a stepping manner in synchronism with a serial scan of the recording head 31 (STEP 16). Since the flapper 64 holds its tip directed upward, the recorded recording sheet 52 is introduced into the second transporting means 65. When the last line has been recorded on the recording sheet 52 (STEP 17), the first transporting means 55*a*, 55*b* and 56*a*, 56*b* are forwardly rotated (STEP 18). Further, the pairs of intermediate rollers 65*a*–65*c* and the pair of discharging rollers 56*b* are forwardly rotated (STEP 19) to discharge the recording sheet 52 on the sheet discharging tray 66 (STEP 20). In this event, if these roller pairs 65*a*–65*d* are driven at a high speed, a transporting time in the second transporting means 65 can be reduced, thereby speeding up the recording operation.

On the other hand, if the synthetic or multiplex recording mode is selected, the following procedure is executed (it is assumed, for the sake of explanation, that a length from the top end of the recording sheet 52 to the end of the recording area by the ink jet recording unit 3 is represented by I, and a distance between the second pair of transporting rollers 56*a*, 56*b* to the pair of resist rollers 68 for the electrophotography recording unit 4 by L).

If I>L stands (STEP 21), the flapper 64 has the tip thereof directed upward (STEP 22), the electrophotography recording unit 4 is set in a standby state (STEP 23), and the recording sheet 52 is fed to the ink jet recording unit 3 up to the top end of the recording area (STEPS 24, 25). Then, recording is started by the ink jet recording unit 3 (STEPS 26, 27), and the top end of the recording sheet 52 is introduced into the second transporting means 65. When a predetermined area has been recorded (STEP 28), the recording head 31 is withdrawn (STEP 29), the first transporting means 55*a*, 55*b* and 56*a*, 56*b* are reversely transported (STEP 30), the recording sheet 52 is returned by a predetermined amount, for example, until the top end of the recording sheet 52 passes through the tip of the flapper 64. This detection may be made, for example, by counting the number of pulses generated by a pulse motor used for driving the first transporting means 55*a*, 55*b* and 56*a*, 56*b*. Alternatively, a detecting means for detecting the top end of a recording sheet may be arranged between the tip of the flapper 64 and the second pair of transporting rollers 56*a*, 56*b*. When the recording sheet 52 has been returned by the predetermined amount (STEP 31), the flapper 64 is switched to direct the tip thereof downward (STEP 32), and the first transporting means 55*a*, 55*b* and 56*a*, 56*b* are forwardly rotated to introduce the recording completed recording sheet 52 into the pair of resist rollers 68 (STEP 33). Afterward, the foregoing STEPs 6–9 are executed to create a synthetic or multiplex recording image.

If I≦L stands at STEP 21, the flapper 64 is switched to direct the tip thereof downward (STEP 34). Therefore, the recorded recording sheet 52 is immediately introduced in the direction of the pair of resist rollers 68 by executing STEPs 35–41 similar to the foregoing STEPs 23–29 and forwardly rotating the first transporting means 55*a*, 55*b* and 56*a*, 56*b* without introducing the recording sheet 52 into the second transporting means 65. The pair of resist rollers 68 are driven at a predetermined timing, and thereafter recording is performed by the electrophotography process at STEPs 6–9 to create a synthetic or multiplex recording image. Therefore, when the synthetic or multiplex recording is performed with I≦L, the recording sheet 52 is directly introduced into the electrophotography recording unit 4 after the ink jet recording without passing through the second transporting means 65, thereby making it possible to save a time required to switch-back transportation of the recording sheet 52 (the sum of a time for withdrawing the recording sheet 52 from the second transporting means 65 and a time for transporting the recording sheet 52 from the second pair of transporting rollers 56*a*, 56*b* to the pair of resist rollers 68).

By providing character fonts and a pattern generator, it is possible to arbitrarily record, as a real image, a corporate name, a corporate mark, a corporate seal, the date, a serial page number or the like on the former half or a corner portion of a recording sheet by the ink jet recording unit 3 in color or monochrome and synthesize the same with an image recorded by the electrophotography recording unit 4. Also, image information (a photograph or a graph) from the image reading section R and image data on computer graphics, if communicated with a computer, can be recorded in color.

Figure 4:
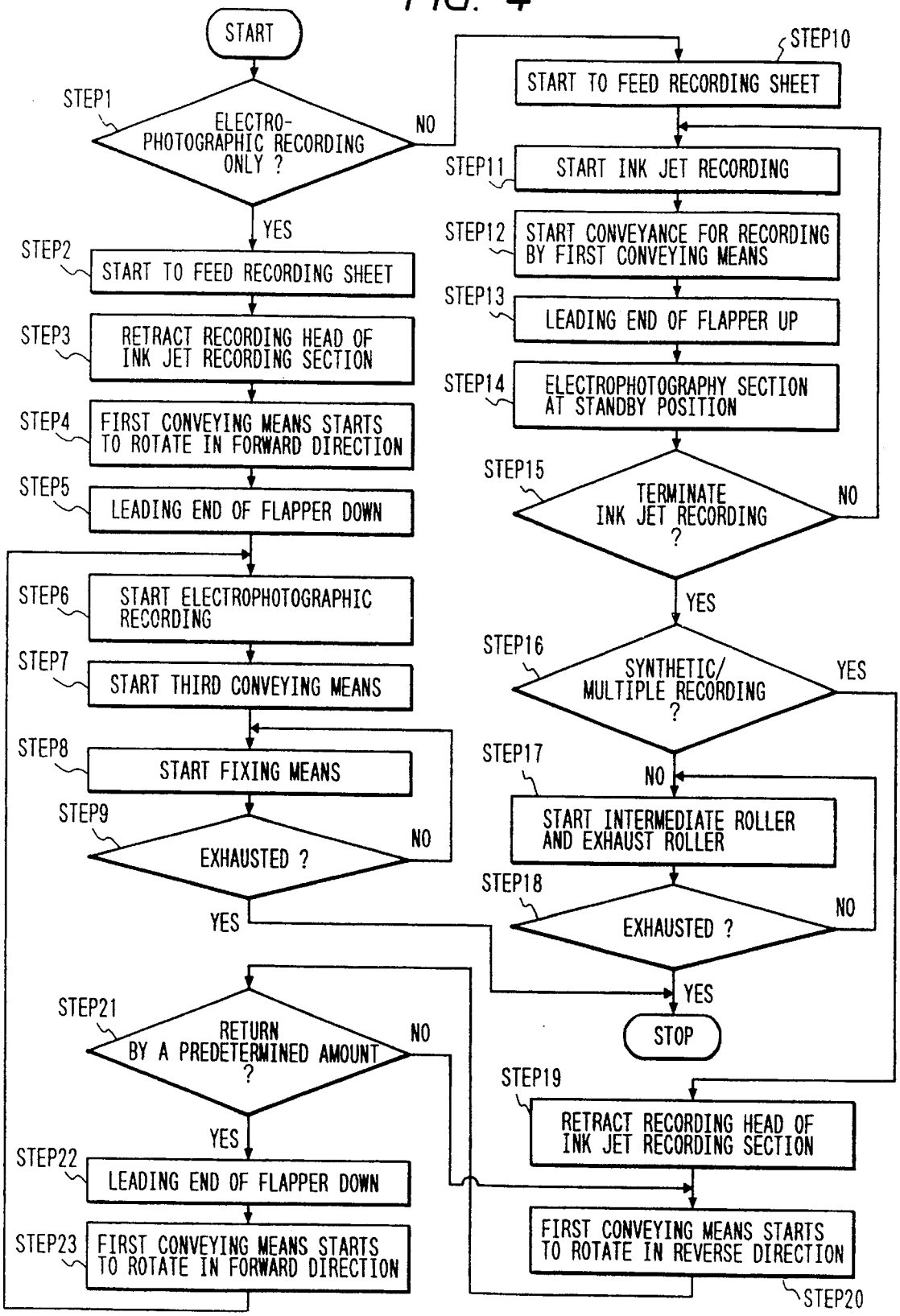
FIG. 4 is a flow chart used for explaining the operation of a second embodiment of an image forming apparatus according to the present invention.

FIG. 4 illustrates an operating procedure of a second embodiment of the image forming apparatus according to the present invention. First, the operator selects one from an electrophotography recording mode (monochrome copy mode), an ink jet recording mode (color recording mode, for example, mono-color or full color recording), a synthetic recording mode by using both the recording units, a multiplex recording mode (for example, colored underlines, color conversion in a specified area, color painting, and base color).

When the electrophotography recording mode is selected (STEP 1), a recording sheet 52 is fed from the cassette 53 or 54 or the manual feeder 62 (STEP 2). In this event, the recording head 31 of the ink jet recording unit 3 stands by at a retract or drawn position (STEP 3), while the first transporting means 55*a*, 55*b* and 56*a*, 56*b* simply transport the recording sheet 52 (STEP 4). Since the flapper 64 has the tip thereof directed downward (STEP 5), the recording sheet 52 reaches the pair of resist rollers 68 to enter an electrophotography recording process (STEP 6). Then, the recording sheet 52 on which a toner image has been transferred is transported by the third transporting means 69, the toner image is fixed by the fixing means 70 (STEPS 7, 8), and the recording sheet 52 is finally discharged on the sheet discharging tray 66 (STEP 9). If the electrophotography recording mode is not selected at STEP 1, ink jet recording is to be first performed (STEP 11) after the recording sheet 52 has been fed (STEP 10). The first transporting means 55*a*, 55*b* and 56*a*, 56*b*, in synchronism with a serial scan of the recording head 31, transport the recording sheet 52 in a stepping manner (STEP 12). The flapper 64 is switched to direct the tip thereof upward (STEP 13) to introduce the recording sheet 52 into the second transporting meads 65. The electrophotography recording unit 4 is in a standby state during the above-mentioned operations (STEP 14). When the last line has been recorded on the recording sheet 52 (STEP 15), if the ink jet recording only has been selected (STEP 16), the pairs of intermediate rollers 65*a*–65*c* and the pair of discharging rollers 65*d* are driven (STEP 17) to discharge the recording sheet 52 on the sheet discharging tray 66 (STEP 18). If these pairs of rollers 65*a*–65*d* are driven at a high speed, a time required to transport the recording sheet 52 through the second transporting means 65 can be reduced, thereby speeding up the recording operation.

At STEP 16, if the synthetic or multiplex recording has been selected, the head 31 is returned to the drawn position after the last line has been recorded (STEP 19). Then, the first transporting means 55*a*, 55*b* and 56*a*, 56*b* are reversely rotated (STEP 20) to return the recording sheet 52 by a predetermined amount, for example, until the top end of the recording sheet 52 passes through the tip of the flapper 64 (STEP 21). This determination may be made, for example, by counting the number of pulses generated by a pulse motor used for driving the first transporting means 55*a*, 55*b* and 56*a*, 56*b*. Alternatively, a detecting means for detecting the top end of a recording sheet may be arranged between the tip of the flapper 64 and the second pair of transporting rollers 56*a*, 56*b*. When the recording sheet 52 has been returned by the predetermined amount, the flapper 64 is switched to direct the tip thereof downward (STEP 22), and the first transporting means 55*a*, 55*b* and 56*a*, 56*b* are forwardly rotated (STEP 23) to transport the recording completed recording sheet 52 to the pair of resist rollers 68. Afterward, the foregoing STEPs 6–9 are executed to create a synthetic or multiplex recording image.

In the image forming apparatus of the present invention, the ink jet recording is first performed and then the electrophotography recording follows on a single recording sheet. The superiority presented by this arrangement will become apparent when compared with a construction where an ink jet recording unit is arranged at a different position in relation to the synthetic or multiplex recording.

Figures 5A, 5B, 5C, 6:
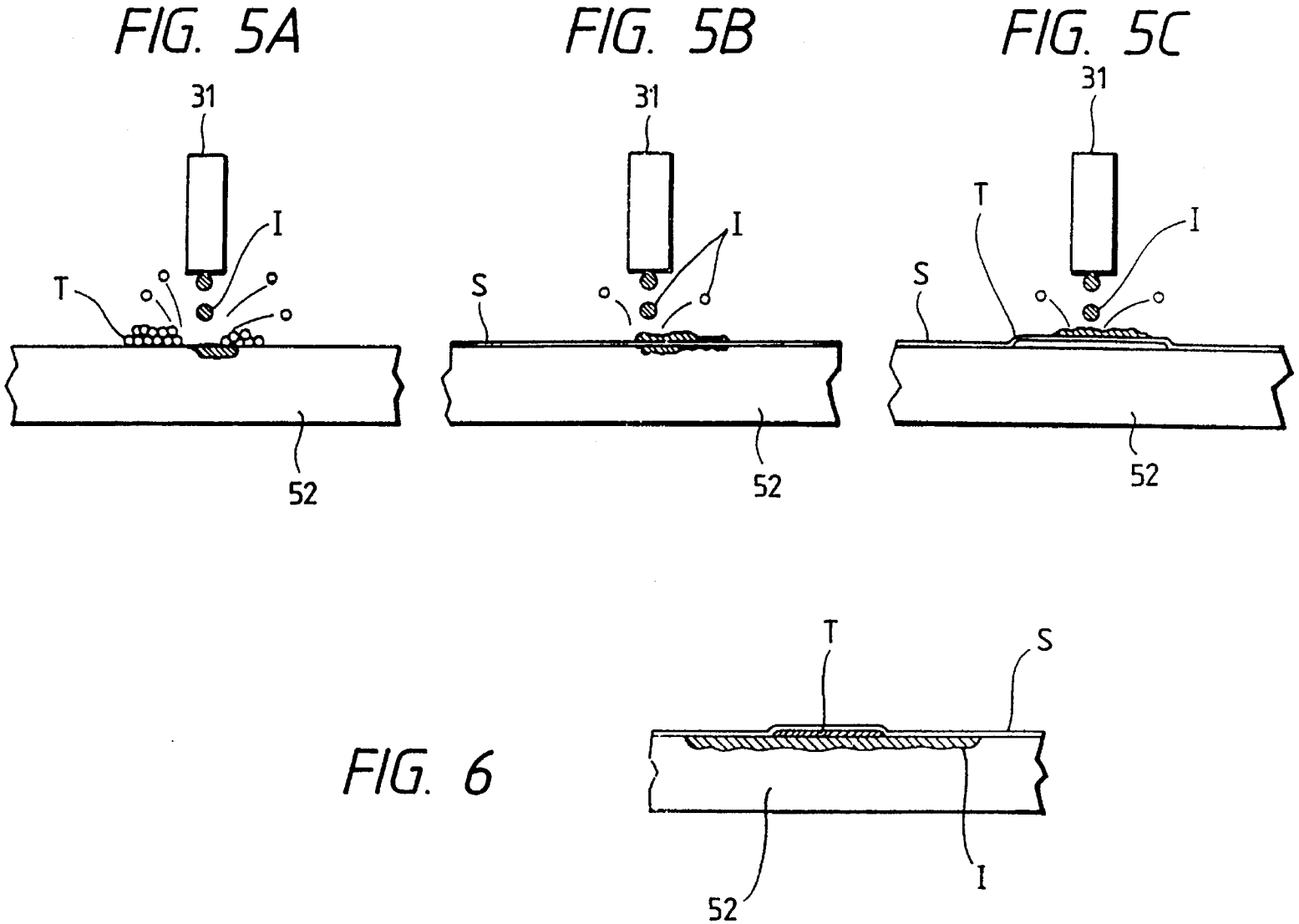
FIGS. 5A–5C are cross-sectional views showing problems which may occur when an ink jet recording unit is not arranged prior to an electrophotography recording unit.
FIG. 6 is a cross-sectional view of a recording sheet used for explaining the superiority of the present invention in which an ink jet recording unit is arranged prior to an electrophotography recording unit.

Specifically, the ink jet recording unit, located at a forward position, is distant from the fixing means 70. Alternatively, if the ink jet recording unit is arranged on the upstream side and the fan 71 is built in the apparatus as described above, the recording head 31 will be completely protected from adverse influences due to heat. Also, advantageously, if the recording sheet 52 after the ink jet recording is coated with silicon oil S, ink I is covered with the oil S and sealed from the atmosphere, that is, it is analogous to laminate the recording sheet 52, whereby a weather-proof characteristic of the recording sheet 52 is improved (see FIG. 6).

Next, a third embodiment of the image forming apparatus according to the present invention will be described with reference to FIG. 7.

An ink jet recording unit 104 records an image one line by one line on a recording sheet 107 by scanning a recording head 104*a* arranged between a first pair of transporting rollers 104*m* and a second pair of transporting rollers 104*n* in a main scanning direction and discharging ink in accordance with image information. The recording sheet 107 is transported in a stepping manner between guiding members 111*a* and 111*b*. In the guiding members 111*a* and 111*b*, one end $\mathbf{111}a_1$ of the upper guiding member 111*a* is arranged such that a gap between the guiding members 111*a* and 111*b* gradually becomes narrower toward a pair of resist rollers 112, whereby the top end of the recording sheet 107 is ensured to enter a nip portion of the pair of resist rollers 112. The other end $\mathbf{111}a_2$ of the upper guiding member 111*a* is arranged apart from the lower guiding member 111*b* to define a space so that the top end of the recording sheet 107 coming into contact with the pair of resist rollers 112 forms a loop.

Figure 7:
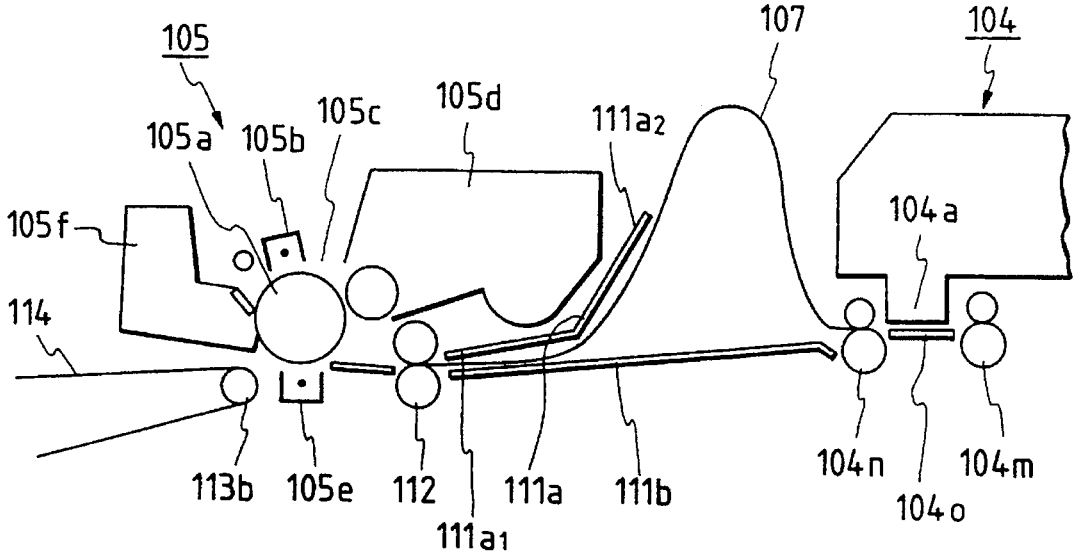
FIG. 7 is a cross-sectional view showing guiding members for guiding transportation of a recording medium.

As shown in FIG. 7, when the top end of the recording sheet 107 reaches the nip portion of the pair of resist rollers 112, since the pair of resist rollers 112 are inoperative, the recording sheet 107 begins to form a loop upward. The recording sheet 107 further loops, as is outputted from the ink jet recording unit 104, and extends over the space between the upper and lower guiding members 111*a* and 111*b*. When the ink jet recording unit 104 has completed recording, synchronization is established by the pair of resist rollers 112 to transport the recording sheet 107 to an electrophotography recording unit 105 for electrophotography recording, whereby a synthetic or multiplex image can be created.

In this embodiment, since the distance between the ink jet recording unit 104 and the electrophotography recording unit 105 is made shorter than the length of the recording sheet 107, the apparatus can be made compact. Also, the same transporting path is used for any recording mode, the recording sheet transporting path can be simplified, which results in easier maintenance to attend to a paper jam or the like.

Also, the recording sheet 107 after the ink jet recording is held in the form of a loop, thereby ensuring a time for drying ink on the recording sheet 52 in a saved space.

Next, a fourth embodiment of the image forming apparatus according to the present invention will be described with reference to FIGS. 8 through 10.

Figure 8:
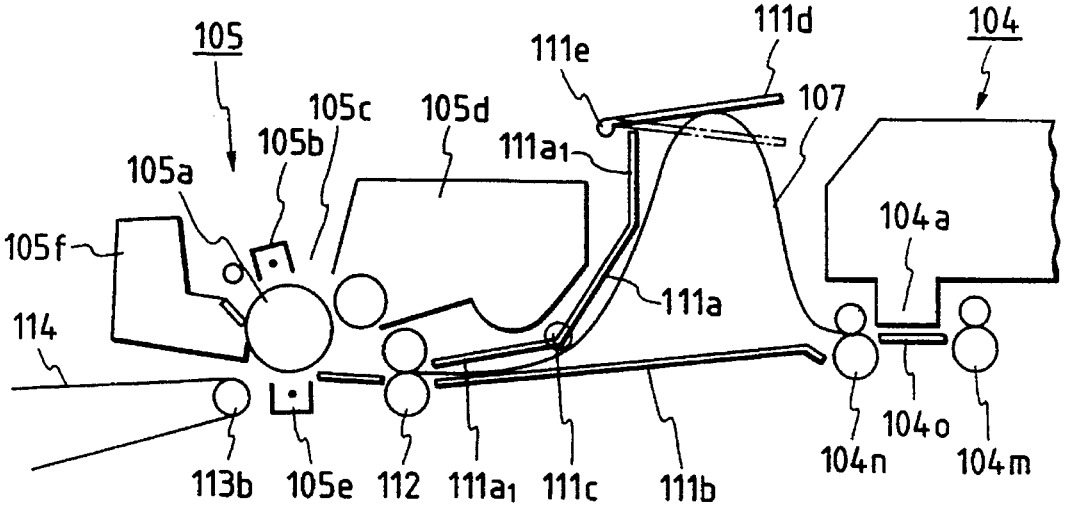
FIG. 8 is a cross-sectional view showing guiding members equipped with a movable member.

Referring first to FIG. 8, an upper guiding member 111*a* is provided at a bent portion with a guiding roll 111*c* and at an end 111$a_2$ with a movable guide 111*d*. The movable guide 111*d* is pivoted at a pin fixed above the upper guiding member 111*a* for swinging movement. When synthetic or multiplex recording is performed on a large size recording sheet, the sheet loops as the ink jet recording advances, as described above. Then, the loop grows to come into contact with the movable guide 111*d* and lift the same upward. In this event, the recording sheet 107 receives a force from the movable member 111*d* in the direction of hindering the loop from extending.

Generally, as the recording sheet 107 is larger, the loop extends more, which results in debilitating a force to forward the recording sheet 107. Also, after ink jet recording has been performed on the recording sheet 107, solidity of the recording sheet 107 is more or less damaged due to moisture of ink soaking thereinto. Therefore, by restricting the growth of the loop formed by the recording sheet 107, a forward thrust for forcing the recording sheet 107 toward the pair of resist rollers 112 is generated to enter the top end of the recording sheet 107 to the nip portion of the pair of resist rollers, thereby ensuring the transportation of the recording sheet 107.

The guiding roll 111*c* is provided for preventing the recorded surface of the recording sheet 107 from rubbing against the upper guiding member 111*a*, which leads to preventing rubbing noise and silencing the transporting operation.

Figure 9:
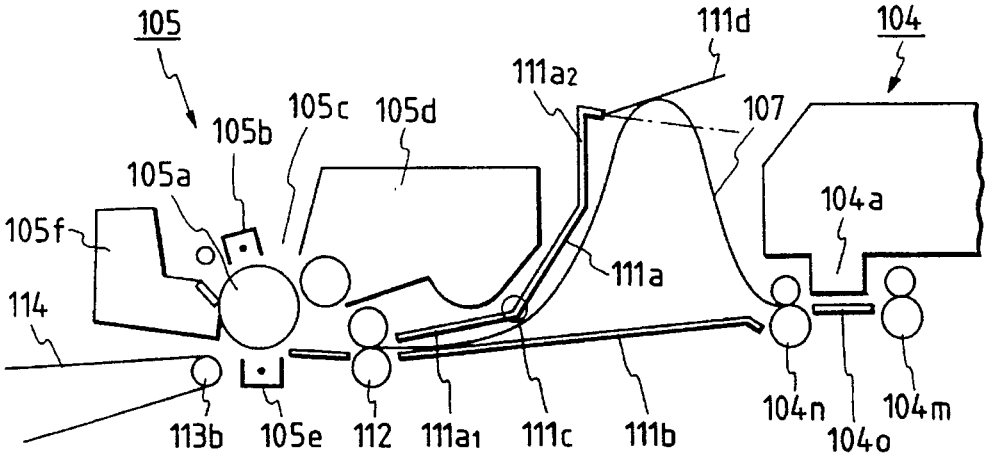
FIG. 9 is a cross-sectional view showing guiding members equipped with a movable member made of a flexible material.

Referring next to FIG. 9, the movable guide 111*d* is made of a flexible material such as a PET (polyethylene terephthalete) film. When the recording sheet 107 loops to lift up the movable guide 111*d*, the PET film is flexed, and its restoring force gives a forward thrust to the top end of the recording sheet 107.

Contrarily, when a small size recording sheet is transported, the recording sheet forms a loop between the pair of resist rollers 112 and the second pair of transporting rollers 104*n* without touching the movable member 111*d*. Suppose, for example, that ink jet recording is performed on an OHP transparency. Generally, the OHP transparency has an ink holding layer coated over a transparent base film made of PET or the like. When the recorded face of the OHP transparency is sandwiched by rollers or rubs against a guiding face, ink may overflow from the ink holding layer. In this embodiment, description will be made as to transportation of an OHP transparency 107*a*.

Figure 10:
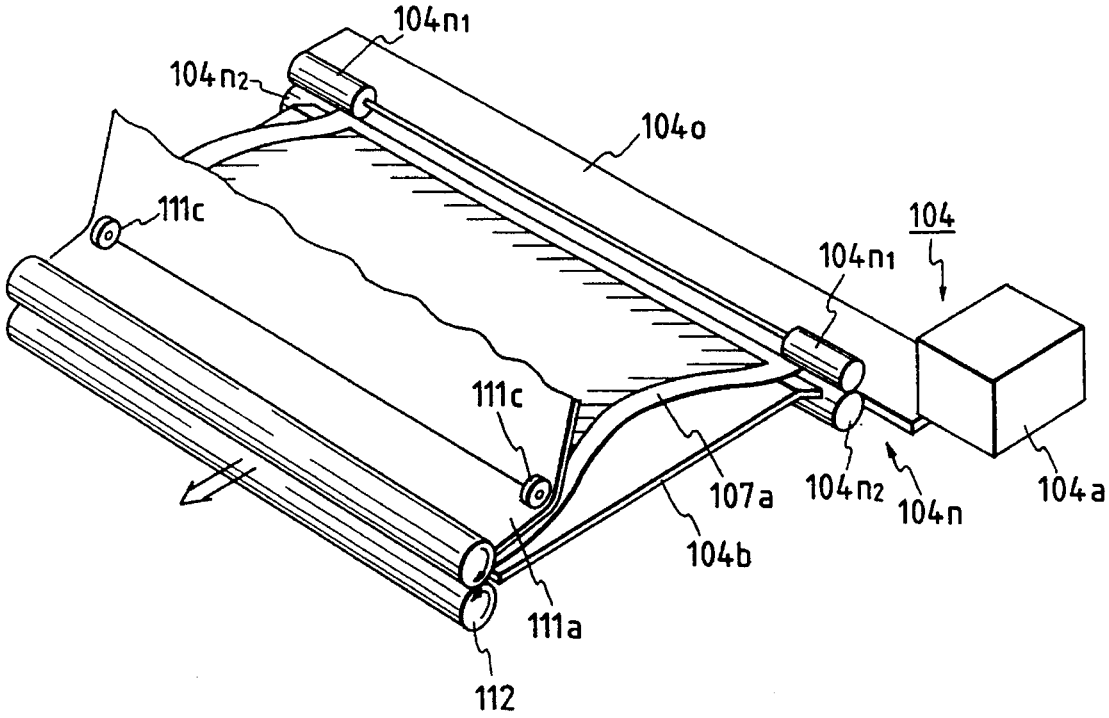
FIG. 10 is a perspective view showing guiding members for transporting an OHP (overhead projector) transparency as a recording medium.

Referring to FIG. 10, after ink jet recording has been performed on the OHP transparency 107*a*, an upper transporting roller 104$n_1$ constituting a second pair of transporting rollers 104*n* comes into contact with a non-image recording area of the OHP transparency 107*a*, and sandwiches the same together with a lower transporting roller 104$n_2$ for transportation. When the top end of the OHP transparency 107*a* reaches the nip portion of the pair of resist rollers 112 and the OHP transparency 107*a* begins forming a loop, the recorded face does not touch the upper guiding member 111*a* but the guiding roll 111*c* arranged in the non-image recording area. By maintaining the OHP transparency 107*a* in a loop form for a predetermined period, ink on the image forming area can be dried, thereby making it possible to prevent the image from being perturbed by the pair of resist rollers 112 or ink from attaching to the pair of rollers.

Incidentally, the present invention produces remarkable effects, particularly, in a recording head and a recording apparatus according to the ink jet recording method which is provided with a means (for example, an electric-thermal convertor, a laser beam or the like) for generating thermal energy utilized as energy for discharging ink such that a conditional change of the ink is generated by this thermal energy. This is because this type of method can achieve high density and high resolution of recording.

The typical structure and principles of the ink jet recording method is preferably implemented by employing the basic principles disclosed, for example, in U.S. Pat. Nos. 4,723,129 and 4,740,796. This method is applicable to either a so-called on-demand type or a continuous type. Particularly, it is effective to the on-demand type since thermal energy is generated in an electro-thermal converting member arranged corresponding to a sheet on which a liquid (ink) is held and a liquid path by applying the same with at least one driving signal corresponding to recorded information for giving a rapid temperature rise exceeding nucleate boiling, film boiling is generated on a heat acting face of a recording head, and consequently bubbles are generated in the liquid (ink) corresponding one by one to this driving signal. The liquid (ink) is discharged through discharging ports by growth and contraction of the bubbles to form at least one drop. It is preferable that a pulse signal is used as the driving signal because the growth and contraction of bubbles are immediately and properly controlled thereby so that discharging of the ink, particularly excellent in a response characteristic, is achieved. As this pulse-shaped driving signal, those described in the specifications of U.S. Pat. Nos. 4,463,359 and 4,345,262 are suitable. Further, if conditions described in the specification of U.S. Pat. No. 4,313,124 concerning a temperature rising ratio on the heat acting face are employed, further excellent recording can be achieved.

It should be noted that the present invention also includes such recording head structures as those using inventions described in the specifications of U.S. Pat. Nos. 4,558,333 and 4,459,600 which disclose a structure in which a heat acting portion is arranged in a bent region, in addition to a combined structure (a straight flow path or a perpendicular flow path) formed of a discharging port, a liquid path and an electric-thermal converting member as disclosed in the above-mentioned respective specifications. Additionally, the present invention is effective also to structures based on Japanese Laid-open Patent Application No. 59-123670 which discloses a structure where common slits serve as a discharging unit for a plurality of electric-thermal convertors, and Japanese Laid-open Patent Application No. 59-138461 which discloses a structure where an opening for absorbing pressure waves of thermal energy is arranged corresponding to a discharging unit. This is because the present invention ensures efficient recording irrespective of the shape of a recording head.

Further, the present invention is effectively applicable to a recording head of full-line type which has a length corresponding to a maximum width of a recording medium over which a recording apparatus can perform recording. Such a recording head may be constructed by a combination of a plurality of recording heads to cover such a length or by a single integrally formed recording head.

Additionally, the present invention is effective also to a serial type recording head, as described in the foregoing example, a recording head fixed in an apparatus, an exchangeable chip-type recording head which is mounted in an apparatus to be electrically connected with the apparatus and to be supplied with ink from the apparatus, or a cartridge type recording head integrally provided thereon with an ink tank.

Also, addition of a recovering means for a recording head, a preparatory supporting means and so on, as constituents of the recording apparatus of the present invention, is preferable since the effect of the present invention can be stabilized by these means. Specifically, these means may be a capping means for a recording head, a cleaning means, a pressurizing or compressing means, a preparatory heating means comprising an electric-thermal convertor, a heating element other than this or a combination of these two, and a preparatory discharging means for performing discharging other than that for recording.

Further, as to the kind and number of mounted recording heads, the present invention is applicable to a recording head which has a plurality of recording heads corresponding to a plurality of kinds of ink which are different in recording color and concentration, other than a recording head which has a single head corresponding to single color ink. Specifically, the present invention is highly effective to a recording apparatus having not only a recording mode in a main color such as black but also at least one of a plural color mode using different colors or a full color mode by mixing different colors, by the use of either an integral recording head or a combination of plural recording heads.

In the embodiments of the present invention described above, although ink was explained as being a liquid, the ink may be such one that is solidified at temperatures less than a room temperature and softened or liquefied at a room temperature. Alternatively, since the ink jet method generally controls the temperature of ink in a range between 30° C. and 70° C. to maintain the viscosity of the ink in a stably discharging condition, a recording head may be used which liquefies the ink when a recording signal is supplied. Thermal energy is positively utilized as energy for changing ink from a solid state to a liquid state to prevent the temperature from rising or the ink from being evaporated due to the thermal energy. It is therefore possible to utilize ink which is normally solid and liquefied by applying heat thereto. After all, the present invention is applicable to a recording head utilizing ink which is liquefied only by applying thermal energy thereto, e.g., ink which is liquefied and discharged by applying thereto thermal energy in response to a recording signal, ink which has already begun to be solidified when reaching a recording medium, and so on. In these cases, ink may be held as a liquid or solid substance in recesses or through holes of a porous sheet as described in Japanese Laid-open Patent Application No. 54-56847 or 60-71260 and arranged opposite to an electric-thermal convertor. In the present invention, the most effective way for the above-mentioned respective ink is to carry out the foregoing film boiling method.

Further additionally, an ink jet recording apparatus to which the present invention is applied may be, other than that used as an image outputting terminal for an information processing machine such as a computer, a copy machine combined with a reader or the like, a facsimile apparatus having transmitting and receiving functions, and so on.

As described above, according to the image forming apparatus of the present invention, the following effects can be produced:

1) By performing an image formation according to an ink jet recording method prior to that according to an electrophotography recording method, a recording head can be completely protected from adverse influences due to heat generated form toner and a fixing means of an electrophotography recording unit, thereby making it possible to create a high-grade image.

2) A recording section can be made compact by forming a color image by the ink jet recording method, while a high-speed and highly productive image formation is accomplished by recording a monochrome image by the electrophotography recording method.

3) By making a distance between an ink jet recording unit and an electrophotography recording unit shorter than the length of a recording sheet, the size of the apparatus can be reduced.

4) When an image forming area of a recording sheet for the ink jet recording unit is not more than a predetermined length from the top end of the recording sheet, the recording sheet is directly introduced into the electrophotography recording unit arranged downstream of the ink jet recording unit, whereby a synthetic or multiplex recording image can be created by a combination of the ink jet recording and the electrophotography recording at a high speed.

What is claimed is:

1. An image forming apparatus for forming an image on a recording medium, said apparatus comprising:

first image forming means for forming an image on a recording medium;

second image forming means for forming an image on the recording medium by an image forming system different from that of said first image forming means;

receiving means for receiving the recording medium after the image is recorded;

a first recording medium conveyance path for conveying the recording medium to said receiving means after passing by said first and second image forming means; and a second recording medium conveyance path for conveying the recording medium to said receiving means after passing by said first image forming means.

2. An apparatus according to claim 1, wherein said first image forming means discharges ink from a nozzle to form an image by an ink jet image forming system.

3. An apparatus according to claim 2, wherein a recording head used for said ink jet image forming system comprises an electrothermal converting element for generating thermal energy causing film boiling in ink as an element for generating energy used for discharging the ink.

4. An apparatus according to claim 3, wherein said recording head comprises a plurality of discharge ports and a recording head for cyan color, a recording head for magenta color, a recording head for yellow color and a recording head for black color are provided to perform full-color recording.

5. An apparatus according to claim 4, wherein said recording heads are mounted on a carriage and are reciprocable in a main scan direction.

6. An apparatus according to claim 4, wherein said recording heads form an image in accordance with digital signals.

7. An apparatus according to claim 2, wherein said second image forming means uses an electrophotographing image forming system and comprises a photosensitive member, a cleaning portion and a transfer portion to form a black-and-white image.

8. An apparatus according to claim 7, wherein said first image forming means which uses the ink jet image forming system is provided upstream in a conveyance direction of said first recording medium conveyance path and said second image forming means which uses the electrophotographing image forming system is provided downstream of said first image forming means relative to the conveyance direction of said first recording medium conveyance path.

9. An apparatus according to claim 7, wherein the recording medium is loaded on a loading means and the recording medium fed from said loading means is selectively conveyed to either of said first and second recording medium conveyance paths by a flapper disposed downstream of said first image forming means which uses the ink jet image forming system.

10. An apparatus according to claim 9, wherein said first and second recording medium conveyance paths are common from said loading means to said flapper.

11. An image forming apparatus for forming an image on a recording medium, said apparatus comprising:

first image forming means for forming an image on a recording medium;

second image forming means for forming an image on the recording medium by an image forming system different from that of said first image forming means;

loading means for loading the recording medium;

receiving means for receiving the recording medium after the image is recorded;

a first recording medium conveyance path for conveying the recording medium fed from said loading means to said receiving means after passing by said first and said second image forming means; and a second recording medium conveyance path branching from said first recording medium conveyance path downstream of said first image forming means and upstream of said second image forming means with respect to a conveying direction of the recording medium to convey the recording medium on which the image is recorded by said first image forming means to said receiving means.

12. An apparatus according to claim 11, wherein said first image forming means discharges ink from a nozzle to form an image by an ink jet image forming system.

13. An apparatus according to claim 12, wherein a recording head used for said ink jet image forming system comprises an electrothermal converting element for generating thermal energy causing film boiling in ink as an element for generating energy used for discharging the ink.

14. An apparatus according to claim 13, wherein said recording head comprises a plurality discharge ports and a recording head for cyan color, a recording head for magenta color, a recording head for yellow color and a recording head for black color are provided to perform full-color recording.

15. An apparatus according to claim 14, wherein said recording heads are mounted on a carriage and are reciprocable in a main scan direction.

16. An apparatus according to claim 14, wherein said recording heads form an image in accordance with digital signals.

17. An apparatus according to claim 11, wherein said second image forming means uses an electrophotographing image forming system and comprises a photosensitive member, a cleaning portion and a transfer portion to form a black-and-white image.

18. An image forming apparatus for forming an image on a recording medium, said apparatus comprising:

first image forming means for forming an image by an ink jet image forming system and for discharging ink from a nozzle to form an image on the recording medium;

second image forming means for forming an image on the recording medium by an electrophotographing image forming system different from that of said first image forming means;

receiving means for receiving the recording medium after the image is recorded;

a first recording medium conveyance path for conveying the recording medium to said receiving means after passing by said first and second image forming means; and a second recording medium conveyance path for conveying the recording medium to said receiving means after passing by said first image forming means.

19. An apparatus according to claim 18, wherein a recording head used for said ink jet image forming system comprises an electrothermal converting element for generating thermal energy causing film boiling in ink as an element for generating energy used for discharging the ink.

20. An apparatus according to claim 19, wherein said recording head comprises a plurality of discharge ports and a recording head for cyan color, a recording head for magenta color, a recording head for yellow color and a recording head for black color are provided to perform full-color recording.

21. An apparatus according to claim 20, wherein said recording heads are mounted on a carriage and are reciprocable in a main scan direction.

22. An apparatus according to claim 20, wherein said recording heads form an image in accordance with digital signals.

23. An apparatus according to claim 18, wherein said second image forming means using the electrophotographing image forming system comprises a photosensitive member, a cleaning portion and a transfer portion to form a black-and-white image.

24. An apparatus according to claim 18, wherein said first image forming means is provided upstream in a conveyance direction of said first recording medium conveyance path and said second image forming means is provided downstream of said first image forming means relative to the conveyance direction of said first recording medium conveyance path.

25. An apparatus according to claim 18, wherein the recording medium is loaded on loading means and the recording medium fed from said loading means is selectively conveyed to either of said first and second recording medium conveyance paths by a flapper disposed downstream of said first image forming means which uses the ink jet image forming system.

26. An apparatus according to claim 25, wherein said first and second recording medium conveyance paths are common from said loading means to said flapper.

27. An image forming apparatus for forming an image on a recording medium, said apparatus comprising:

first image forming means for forming an image by an ink jet image forming system and for discharging ink from a nozzle to form an image on the recording medium;

second image forming means for forming an image on the recording medium by an electrophotographing image forming system different from that of said first image forming means;

loading means for loading the recording medium;

receiving means for receiving the recording medium after the image is recorded;

a first recording medium conveyance path for conveying the recording medium fed from said loading means to said receiving means after passing by said first and said second image forming means; and a second recording medium conveyance path branching from said first recording medium conveyance path downstream of said first image forming means and upstream of said second image forming means with respect to a conveying direction of the recording medium to convey the recording medium on which the image is recorded by said first image forming means to said receiving means.

28. An apparatus according to claim 27, wherein a recording head used for said ink jet image forming system comprises an electrothermal converting element for generating thermal energy causing a film boiling in ink as an element for generating energy used for discharging the ink.

29. An apparatus according to claim 28, wherein said recording head comprises a plurality of discharge ports and a recording head for cyan color, a recording head for magenta color, a recording head for yellow color and a recording head for black color are provided to perform full-color recording.

30. An apparatus according to claim 29, wherein said recording heads are mounted on a carriage and are reciprocable in a main scan direction.

31. An apparatus according to claim 29, wherein said recording heads form an image in accordance with digital signals.

32. An apparatus according to claim 27, wherein said second image forming means using the electrophotographing image forming system comprises a photosensitive member, a cleaning portion and a transfer portion to form a black-and-white image.

* * * * *